US005216325A

United States Patent [19]

Patel et al.

[11] Patent Number: 5,216,325

[45] Date of Patent: Jun. 1, 1993

[54] SPARK GAP DEVICE WITH INSULATED TRIGGER ELECTRODE

[75] Inventors: Chiman R. Patel, New Haven; Timothy B. Bonbrake; Barry L. Driscoll, both of Fort Wayne, all of Ind.

[73] Assignee: Magnavox Government and Industrial Electronics Company, Fort Wayne, Ind.

[21] Appl. No.: 469,898

[22] Filed: Jan. 24, 1990

[51] Int. Cl.[5] ..... H01J 7/30; H01J 17/12

[52] U.S. Cl. ..... 313/595; 313/308; 313/601

[58] Field of Search ..... 313/595, 596, 130, 308, 313/603, 601; 361/120; 102/202.5, 202.7, 202.9

[56] References Cited

U.S. PATENT DOCUMENTS

| | | | |
|---|---|---|---|
| 571,099 | 11/1896 | Skinner | 313/308 X |
| 3,675,069 | 7/1972 | Crossen | 313/595 X |
| 3,748,522 | 7/1973 | Geppert | 313/308 X |
| 4,092,559 | 5/1978 | Dashuk | 313/308 X |
| 4,096,541 | 6/1978 | Bohin et al. | 313/308 X |
| 4,840,122 | 6/1989 | Nerheim | 102/202.5 |
| 4,935,666 | 6/1990 | McCann | 313/595 |

OTHER PUBLICATIONS

"Triggered Multichannel Surface Spark Gaps", by H. M. von Bergmann, *Journal of Physics E. Scientific Instruments*, vol. L5, No. 2, Feb. 1982, Dorking, GB, pp. 243-247.

*Primary Examiner*—Palmer C. DeMeo

*Attorney, Agent, or Firm*—Roger M. Rickert; Richard T. Seeger

[57] ABSTRACT

An improved solid state spark gap for use, for example, in firing munitions. The spark gap is formed by depositing a trigger electrode on a dielectric substrate, precisely covering the trigger electrode and an adjoining area with a dielectric layer, and forming an anode and a cathode on the dielectric layer with a spark gap there between. The anode and cathode do not overlap the trigger electrode. The spark gap may be enclosed within a hermetically sealed inert gas filled cover.

7 Claims, 1 Drawing Sheet

SPARK GAP DEVICE WITH INSULATED TRIGGER ELECTRODE

TECHNICAL FIELD

The invention relates to spark gaps and more particularly to a solid state spark gap for discharging, for example, a capacitor charged to a high voltage to fire a munitions fuze.

BACKGROUND ART

In certain fuze applications, munitions are fired by rapidly discharging to the fuze energy from a capacitor charged to a high voltage. The rapid discharge from the capacitor creates a high current flow to a fuze. A device called a spark gap is sometimes used to conduct a large amount of current when a specified voltage is applied. The spark gap must conduct current at a given threshold voltage, but must not conduct current at a lower operating voltage. Two spark gap type devices are currently in use for firing munitions, namely, a silicon controlled rectifier (SCR) and a gas discharge tube. The SCR is a solid state device having an anode, a cathode and a gate. When a suitable voltage is applied to the gate, current flows between the anode and the cathode. However, an SCR does not have the high current capability required to switch a high voltage. Therefore, it is not suitable for many applications.

The gas discharge tube has been used where higher currents are encountered. Gas discharge tubes are expensive to manufacture. They are in the form of a sealed gas filled tube having anode, cathode and trigger electrodes positioned within the tube. The tube is designed such that a high voltage applied between the anode and the cathode is insufficient to break down the gap between the anode and the cathode. However, when a lower voltage is applied to the trigger electrode, the breakdown voltage between the anode and the cathode is reduced to below the applied voltage and a rapid discharge occurs. A trigger energy of perhaps 0.5 millijoules may control, for example, the discharge of 2 millijoules or more to fire a munitions fuze, such as an exploding foil initiator bridge.

Modern munitions have a solid state electronic fuze arming and firing circuit. The overall circuit reliability is reduced and the manufacturing cost is increased when a gas discharge tube is used in conjunction with the arming and firing circuit. The gas discharge tube is both expensive to manufacture and expensive to install in the firing circuit. For a conventional gas discharge tube, as many as 6 electrical connections must be made and the tube must be physically mounted on the circuit board, for example, by the use of clamps or solder or an epoxy adhesive. Further, sufficient space must be provided for mounting the tube, which may be relative large.

DISCLOSURE OF INVENTION

According to the invention, a munitions arming and firing circuit is provided with a small integral solid state spark gap for controlling the discharge of energy from a high voltage charged capacitor to a fuze initiator, such as a slapper detonator exploding foil initiator. The spark gap may be formed on the same substrate on which the arming and firing circuit is formed and both may be formed at the same time. The spark gap consists of an anode, a cathode and a trigger electrode which are formed, for example, with conventional thick film technology. The trigger electrode is formed as a first layer on a dielectric substrate. The trigger and the adjoining substrate are covered with a precisely controlled dielectric pattern, as a second layer. A third precisely controlled layer forms a separate cathode and anode. The cathode and anode have a controlled spark gap between them and do not overlap the trigger electrode. Optionally, a dielectric fourth layer may cover part of the cathode and anode, so long as both are exposed at the spark gap. For some applications, the above described spark gap may operate exposed to the ambient atmosphere. For other application, the spark gap is enclosed in a hermetically sealed structure which may be filled with an inert gas such as nitrogen. The sealed structure may be, for example, a ceramic cover fused, soldered or otherwise bonded to the substrate and the electrodes.

The solid state spark gap functions similar to a gas discharge tube. The anode and cathode are maintained at the same potential as the charge on an energy storage capacitor. The voltage on the anode and cathode is insufficient to break down the spark gap. However, when a trigger pulse is applied to the trigger electrode, the gas atoms above the trigger ionize to lower the spark gap breakdown voltage to below the applied voltage. At this instance, the energy is rapidly discharged across the spark gap to fire the fuze initiator.

When the spark gap is integrally formed on the same substrate as the arming and firing circuit, the manufacturing cost is reduced. The spark gap is less expensive to manufacture than a gas discharge tube. Conventional circuit manufacturing technology permits precise orientation of the electrodes to achieve accurate triggering voltages. Finally, the expenses of mounting the gas discharge tube and of making the required electrical connections are eliminated.

Accordingly, it is an object of the invention to provide an improved spark discharge device for use, for example, in firing munitions.

Other objects and advantages of the invention will be apparent from the following detailed description and the accompanying drawings.

BEST MODE FOR CARRYING OUT THE INVENTION

Figure 1:
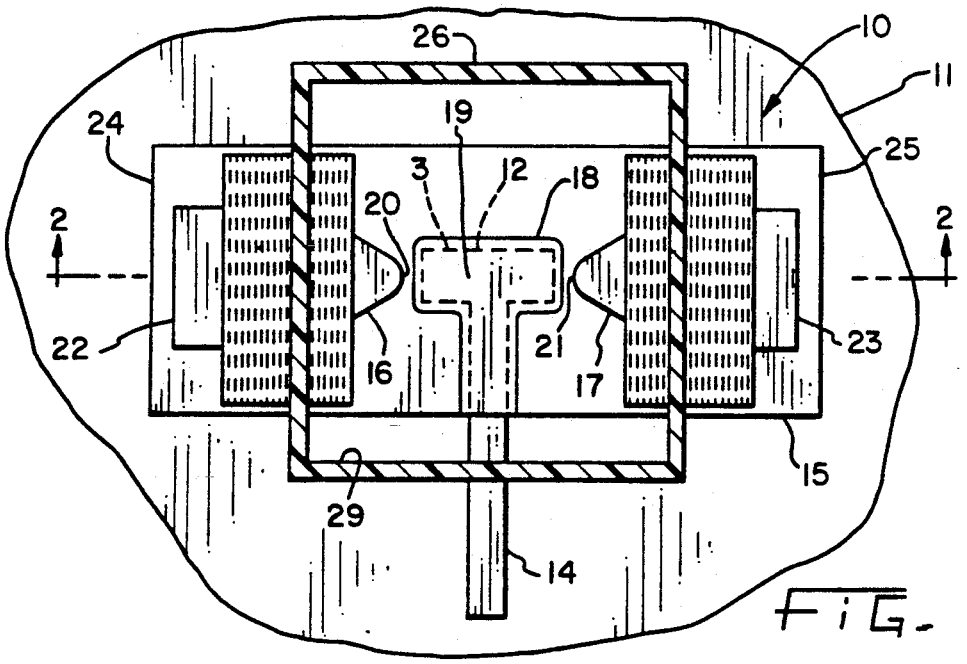
FIG. 1 is a top plan view of an improved spark gap according to the invention.
Figure 2:
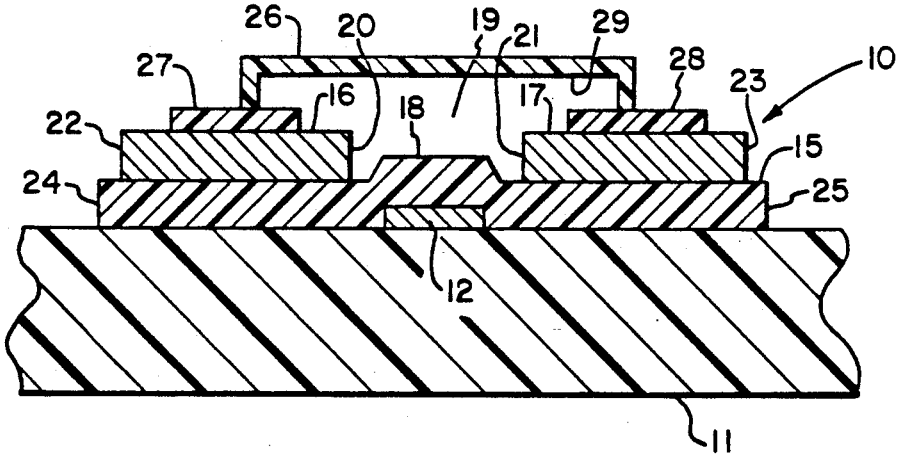
FIG. 2 is a cross sectional view taken along line 2—2 of FIG. 1.

Referring to FIGS. 1 and 2 of the drawings, a solid state spark gap device 10 is shown according to the invention. The spark gap device 10 is formed on a dielectric substrate 11, which may be a ceramic substrate or the foundation used for normal thick film circuit processing techniques. In the preferred embodiment, the spark gap 10 device is formed from several layers sequentially deposited as thick films on the substrate 11. A trigger electrode 12 is deposited as a first layer. The trigger electrode 12 is formed from an electrically conductive material. In the illustrated spark gap 10, the trigger electrode 12 has a generally rectangular body 13 connected to a terminal 14. However, it will be appreciated that the body 13 may have other shapes.

A dielectric second layer 15 is deposited over the trigger electrode body 13, an adjacent portion of the terminal 14 and a predetermined adjacent area on the substrate 11. The second layer 15 is sufficiently large to provide space for an anode 16 and a cathode 17. The dielectric second layer 15 is deposited with a substantially uniform thickness. Consequently, the layer 15 will have a raised portion 18 where it extends over the thick film forming the trigger electrode 12. The anode 16 and the cathode 17 are deposited as separate portions of a third layer on the dielectric second layer 15. The anode 16 and the cathode 17 are electrically conductive layers deposited on the second layer 15 so as to lie opposite the substrate 11 and not opposite the trigger electrode 12. The anode 16 and the cathode 17 may be of identical construction and are interchangeable in electrical connections to adjoining circuitry. The anode 16 has a terminal end 22 and the cathode 17 has a terminal end 23. The terminal ends 22 and 23 may be on the second layer 15, as illustrated, or they may extend, respectively, over edges 24 and 25 of the second layer 15 and onto the substrate 11 for connecting directly to other circuitry (not shown) on the substrate 11.

A spark gap 19 is formed between edges 20 and 21, respectively, of the anode 16 and the cathode 17. The spark gap 19 extends over the raised portion 18 of the dielectric layer 15 and, hence, extends opposite the trigger electrode 12. For many applications, the solid state spark gap device 10 will function adequately with no additional components or layers. However, the device 10 must be located where the spark gap 19 is protected from dust, moisture and other contaminations which may lower or change the voltage required to break down the spark gap 19. If the breakdown voltage is lowered, the spark gap 19 may discharge prematurely.

If additional protection for the spark gap 19 is desired or required by ambient conditions, a cover 26 may enclose the spark gap 19. An optional fourth dielectric layer 27 may be deposited to extend over a portion of the anode 16 and a portion of the adjacent second layer 15. However, the layer 27 does not cover the spark gap edge 20 or the terminal end 22 of the anode 16. Similarly, an optional fourth dielectric layer 28 may be deposited to extend over a portion of the cathode 17 and a portion of the adjacent second layer 15. The layer 28 does not cover the spark gap edge 21 or the terminal end 23 of the cathode 17. The cover 26 may be fused or bonded to the fourth layers 27 and 28, the second layer 15 and the substrate 11 with, for example, a sealing glass to form an enclosed chamber 29 surrounding the spark gap 19. Of course, the cover 26 may be bonded in place by other means, such as by an epoxy resin. The chamber 29 may be filled with dry air or with an inert gas such as nitrogen for maintaining controlled conditions at the spark gap 19.

For operation of the spark gap device 10 in a firing circuit (not shown), a predetermined potential is maintained between the anode 16 and the cathode 17 by a charged capacitor. At the proper time and conditions, a trigger pulse is applied to the trigger electrode 12. The pulse on the trigger electrode 12 produces ionization of some gas atoms in the spark gap 19, thereby lowering the breakdown voltage across the spark gap 19 to below the potential applied between the anode 16 and cathode 17. When discharge takes place across the spark gap 19, the energy stored in the capacitor is dumped to a load as a high current pulse of short duration. It should be noted that the device 10 is particularly suitable for single use applications, such as for firing or initiating munitions. The solid state spark gap device 10 is not designed for withstanding spark erosion which will occur under continuous high current arcing. It was stated above that the anode 16 and the cathode 17 are formed on the second layer 15 so as not to extend opposite the trigger electrode 12 and that the spark gap 19 lies opposite the trigger electrode 12. If the anode 16 and/or the cathode 17 overlap the trigger electrode 12, the electric field will be concentrated in the portions of the second layer 15 between the overlapping anode 16 and/or cathode 17 and trigger electrode 12. As a consequence, a higher trigger voltage will be required to initiate breakdown at the spark gap 19 because any given trigger voltage will result in less ionization at the spark gap.

It will be appreciated that the solid state spark gap device 10 may be manufactured using various known technologies. For example, the device 10 may be manufactured by conventional thick film processing techniques such as screen printing, drying and firing. Or, the device may be manufactured using known processes involving the use of a photoresist and selective etching techniques. Further, the spark gap device 10 may be formed as an integral element on a substrate which includes other circuitry, or it may be formed as a separate element which can be connected to other circuitry.

Figure 3:
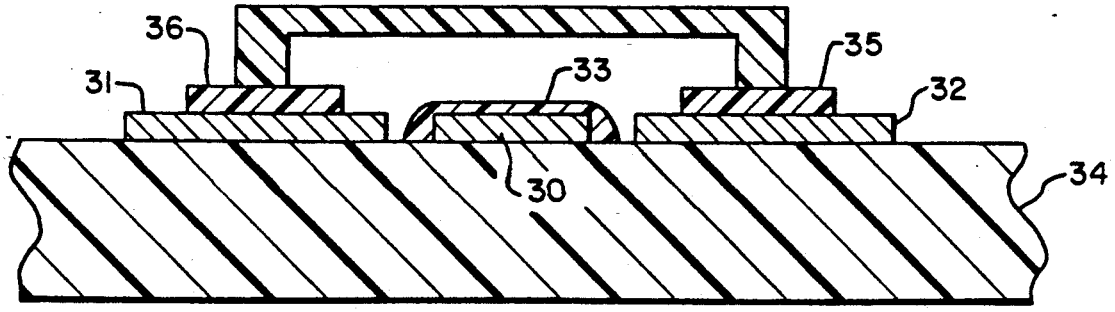
FIG. 3 is a view in cross section similar to FIG. 2, but illustrating a modified form of the invention.

One optional construction is illustrated in FIG. 3 where a first conductive layer comprises the trigger 30, anode 31, and cathode 32 formed on the common substrate 34. These three electrodes are electrically separated from one another, but are formed at the same time on the substrate as one layer. A precisely controlled dielectric 33 covers only the trigger 30 as a second layer. The remaining construction would be as mentioned above with the spark gap device of FIG. 3 differing from that of FIGS. 1 and 2 in that the three electrodes 30, 31 and 32 are substantially coplanar allowing for the elimination of one of the layer forming steps in the process. Thus, the optional dielectric layers 35 and 36 (which correspond to the fourth layer 27 and 28 in FIG. 2) are the third layer in FIG. 3.

Various other modifications and changes to the above described preferred embodiment of the solid state spark gap device 10 will be apparent to those skilled in the art without departing from the spirit and the scope of the following claims.

We claim:

1. A spark gap device comprising a dielectric substrate, a first electrically conductive layer on said substrate forming a trigger electrode, a dielectric layer on said substrate covering said trigger electrode and a predetermined adjacent area of said substrate, separate electrically conductive layers on predetermined portions of said dielectric layer forming a separate anode and cathode, said anode and cathode having a predetermined spacing defining a relatively narrow spark gap of a length greater than that of the trigger electrode, and wherein said spark gap extends over said dielectric layer opposite said trigger electrode and wherein said anode and cathode extend over said dielectric layer opposite said substrate.

2. A spark gap device, as set forth in claim 1, and further including a cover enclosing said spark gap.

3. A spark gap device, as set forth in claim 2, wherein said cover is a ceramic cover fused to said anode, said cathode, said dielectric layer and said substrate.

4. A spark gap device, as set forth in claim 3, wherein said cover is filled with an inert gas.

5. In combination with a circuit mounted on a dielectric substrate, a spark gap device for use with said circuit comprising a first electrically conductive layer on said substrate forming a trigger electrode, a dielectric layer on said substrate covering said trigger electrode and a predetermined adjacent area of said substrate, further electrically conductive layers on predetermined portions of said dielectric layer forming a separate anode and cathode, said anode and cathode having a predetermined spacing defining a spark gap, and wherein said spark gap extends over said dielectric layer opposite said trigger electrode and wherein said anode and cathode extend over said dielectric layer opposite said substrate.

6. The combination of claim 5 wherein the dimension of said trigger electrode in the direction of the predetermined spacing is less than said predetermined spacing, and the anode and cathode are generally symmetrically positioned relative to the trigger electrode so that neither the cathode nor the anode extends over the trigger electrode.

7. A spark gap device comprising a dielectric substrate, a first electrically conductive layer on said substrate forming a trigger electrode, a dielectric layer on said substrate covering said trigger electrode and a predetermined adjacent area of said substrate, separate electrically conductive layers on predetermined portions of said dielectric layer forming a separate anode and cathode, said anode and cathode having a predetermined spacing defining a spark gap of a length greater than that of the trigger electrode, and wherein said spark gap extends over said dielectric layer opposite and beyond said trigger electrode and wherein said anode and cathode extend over said dielectric layer opposite said substrate.

* * * * *